United States Patent [19]

Sheppard et al.

[11] Patent Number: 4,660,478

[45] Date of Patent: Apr. 28, 1987

[54] SLAGGING COMBUSTOR WITH EXTERNALLY-HOT FUEL INJECTOR

[75] Inventors: Douglas B. Sheppard, Torrance; Albert Solbes, Rancho Palos Verdes; Gabriel D. Roy, Torrance, all of Calif.

[73] Assignee: TRW Inc., Redondo Beach, Calif.

[21] Appl. No.: 670,416

[22] Filed: Nov. 13, 1984

[51] Int. Cl.[4] ..... F23D 1/02

[52] U.S. Cl. ..... 110/264; 110/263; 431/160

[58] Field of Search ..... 110/264, 347, 263; 431/158, 160

[56] References Cited

U.S. PATENT DOCUMENTS

| | | | |
|---|---|---|---|
| 2,335,188 | 11/1943 | Kennedy | 431/160 X |
| 3,124,086 | 3/1964 | Sage et al. | 110/264 |
| 4,067,682 | 4/1978 | Lado . | |
| 4,150,874 | 4/1985 | Hasenack | 110/263 X |
| 4,217,132 | 8/1980 | Burge et al. . | |
| 4,408,548 | 10/1983 | Schmalfeld et al. | 110/347 |
| 4,421,039 | 12/1983 | Llinares, Jr. . | |
| 4,473,379 | 9/1984 | Liu | 110/347 X |
| 4,523,529 | 6/1985 | Poll | 110/263 |

*Primary Examiner*—Edward G. Favors

*Attorney, Agent, or Firm*—John P. Grinnell; Benjamin DeWitt

[57] ABSTRACT

In a combustion zone a fuel injector is immersed in a mixture of oxidant and products of combustion having a temperature of about 2000 degrees F. or higher. In order to maintain rapid and stable combustion, it is desirable to avoid excessive absorption of thermal energy from this mixture. To that end, the present invention provides means for impeding transfer of heat to the fuel injector from the adjacent mixture, such that portions of the mixture immediately adjacent the fuel injector may be kept at a temperature of approximately the ash-fusion temperature of the fuel, or higher, while the interior of the fuel injector is kept at a temperature substantially below the ash-fusion temperature. This means for impeding heat transfer preferably comprises at least one material having a thermal conductivity substantially lower than that of the fuel injector and, in a preferred embodiment, consists essentially of slag formed from noncombustible-mineral constituents of the fuel.

36 Claims, 6 Drawing Figures

10
12
14
16
18
20
22
24
26
28
30
36
38
40

SLAGGING COMBUSTOR WITH EXTERNALLY-HOT FUEL INJECTOR

BACKGROUND OF THE INVENTION

In advanced slagging combustion systems for the combustion of particulate carbonaceous materials, such as coal, introduced with a carrier fluid which may be liquid or gaseous, it is important that ignition be achieved as quickly as possible and that the flame front be maintained at or close to the point of fuel introduction. If not, there will be a delay in ignition and, because the residence time in the slagging combustor is in the order of a few-hundred milliseconds, a greater chance exists that combustion instabilities may arise, and/or that fuel particles may exit the combustion chamber before the carbon content of the particles is converted to gaseous products of combustion. In addition, if the flame front is too far away from the point of injection, the flame tends to be unstable.

In the slagging combustion system described herein, a nozzle assembly projects into the combustion chamber. Active combustion takes place at or close to the orifices of the nozzle, i.e., atomizer or pintle. To avoid agglutination and/or partial carburization of the powdered coal, with consequent clogging of the nozzle assembly, the injector assembly normally is fluid-cooled. Fluid cooling the injector increases its durability and reliability; but such cooling also tends to cool the mixture of oxidizer, fuel and combustion products surrounding the injector. This adversely affects combustion. The problem is aggravated in the use of coal-water slurries, where a large amount of water is injected into the combustor and requires vaporization, but is also significant when particulate coal is fluidized and introduced by means of a carrier gas.

In this class of high-power-density combustion systems, the fuel injector is immersed in a mixture of oxidizer, fuel and combustion products at temperatures of the order of 2000 to 3800 or more degrees F. Yet, the injector per se must operate at temperatures low enough for fuel to flow through the injector passageways without significant agglomeration, carburization or plugging of these passageways. At the same time, for good flame stability and consistently low-$NO_x$ combustion, the combustion mixture adjacent the injection assembly ought to be kept at a more-or-less uniform operating temperature. Thus the primary object of my invention is to keep the injector relatively cool, while preventing it from significantly inhibiting or delaying combustion in the surrounding space.

The present invention meets the foregoing objectives by providing a barrier for minimizing transfer of thermal energy to the injector from the surrounding mixture of fuel and gas. It prevents the injector from cooling the adjacent gases, and protects and injector from potentially-damaging thermal flux.

SUMMARY OF THE INVENTION

There are provided improvements in a process and apparatus for the combustion of particulate carbonaceous material in an elongate combustion zone. The combustion zone has an end wall from which the fuel-injection assembly extends into a rotationally and axially flowing heated oxidant flow field. Combustion causes formation of molten slag from the normally solid noncombustible constituents of the fuel. The molten slag flows along inner surfaces of the combustion chamber; and if the exterior surfaces of the nozzle were relatively cool, combustion closely adjacent thereto would be inhibited and delayed.

The invention is directed to avoiding, by the use of suitable means, deleterious cooling of a mixture of oxidant and products of combustion immediately adjacent the point of fuel injection and carrier fluid. The suitable means is adapted to impede transfer of heat to the fuel injection assembly from the immediately adjacent mixture of oxidant and products of combustion by including on the external surface of the injector a material having a thermal conductivity lower than that of the injector.

The material is preferably slag resulting from combustion of the fuel. This avoids excessive absorption of thermal energy from the mixture of oxidant and products of combustion. In consequence, the thermal energy can be used to rapidly heat fuel and oxidant entering the combustion zone to the temperature of the combustion chamber, proximate the point of fuel injection.

Preferably, the means for impeding transfer of heat to the injector from the adjacent mixture of oxidant and products of combustion, includes a metal sleeve surrounding a major portion of the exterior of the fuel injector and means on the metal sleeve for retaining slag and for keeping the interior of the metal sleeve at a temperature substantially below the ash-fusion temperature of the fuel.

Preferably, the slag-retaining portion of the injector assembly is a sleeve-like member comprising a first elongate conduit providing a first inner surface for engaging the body of said nozzle and a first outer surface; a second elongate conduit providing a second inner surface and a second outer surface annularly spaced from said first outer surface. An end wall couples said first elongate conduit and second elongate conduit. This provides an annular fluid flow channel between the first and second conduits. The end wall is adapted to be positioned adjacent to the nozzle's ejection orifice or slot. Walls divide said annular fluid flow channel into a fluid inlet conduit and a fluid outlet conduit. Ribs or pins project outward from said second outer surface, and engage and retain slag on the outer surface, forming a self-healing layer of solidified slag which provides sufficient insulation so that molton slag flows continuously over the exterior of the solidified slag. This molten slag is maintained at temperatures nearly as high as the surrounding mixture of fuel and gases. It, therefore, facilitates combustion closely adjacent the nozzle assembly and the fuel-injecting end thereof.

DETAILED DESCRIPTION

The present invention is directed to improvements in a compact apparatus and system for efficiently combusting particulate carbonaceous materials delivered to the combustion apparatus in the form of a dense-phase fluidized stream of solid particles transported by a carrier fluid which may be a liquid or a gas, and wherein non-combustible constituents of the fuel are removed to the highest levels possible, in the form of molten slag. Basic to the system is the improvement which is brought about by the use of methods and apparatus which, in cooperation, enable particulate carbonaceous materials to be combined with pre-heated oxidant, typically air, under conditions such that ignition occurs and combustion continues in fluid dynamic flow fields.

As will be explained, the instant improvement resides in a system which maintains adjacent layers of solidified slag and semi-molten slag externally insulating the injector assembly used to inject the bulk of the carbonaceous fuel. This stabilizes and enhances reliable, consistent combustion closely adjacent the fuel injector.

A. The Slagging Combustion System

Figure 1:
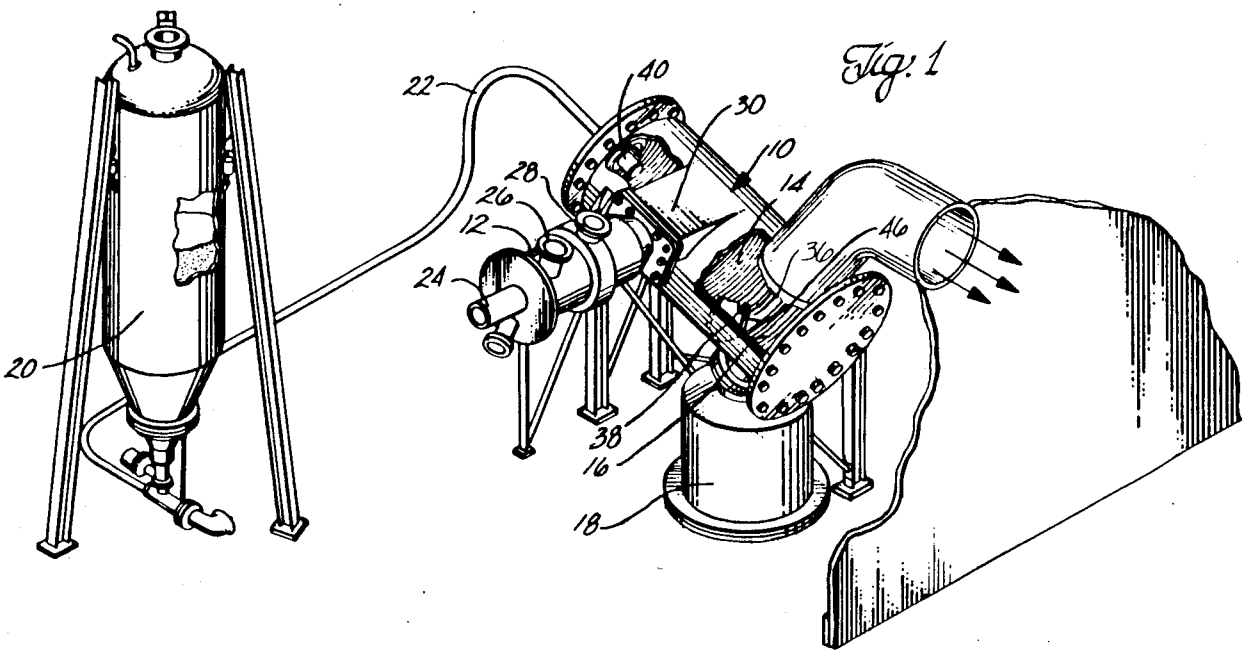
FIG. 1 is a perspective arrangement of a slagging combustion system in relation to an effluent-consuming furnace.
Figure 2:
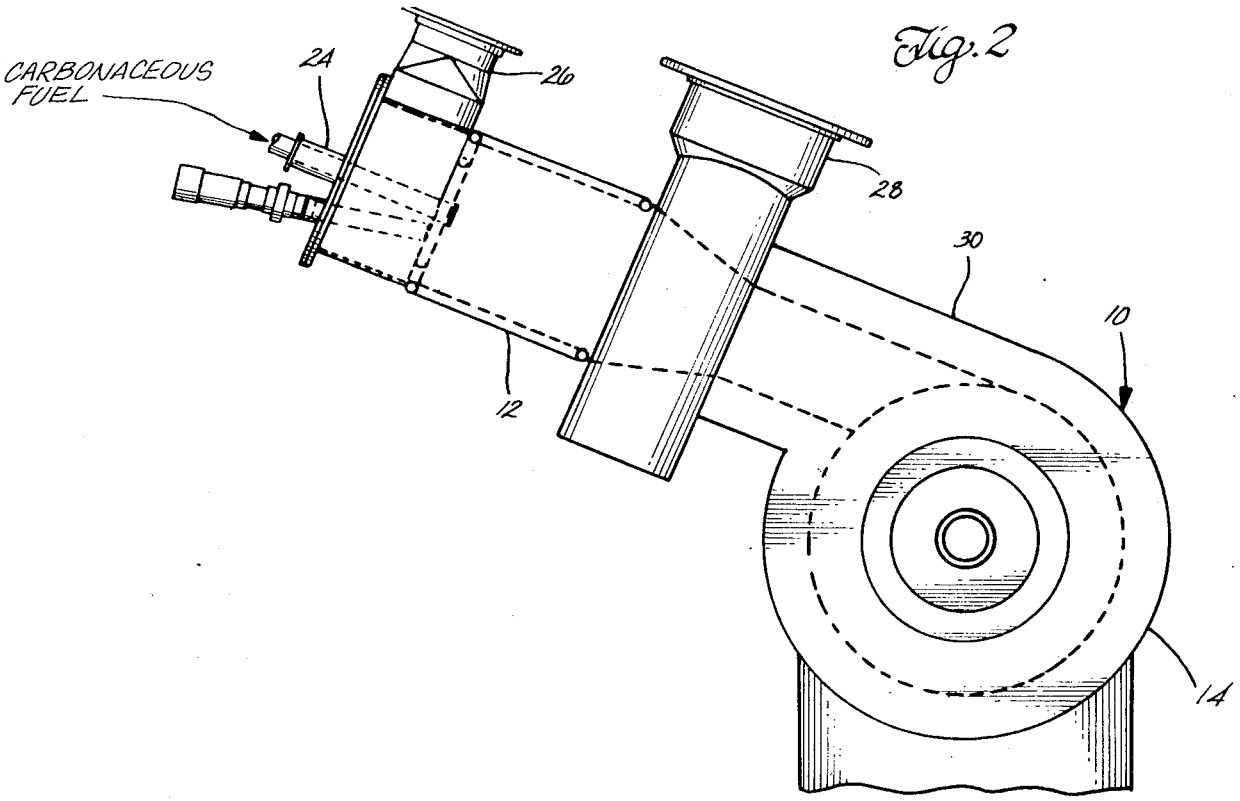
FIG. 2 illustrates the precombustor of the slagging combustion system of FIG. 1.
Figure 3:
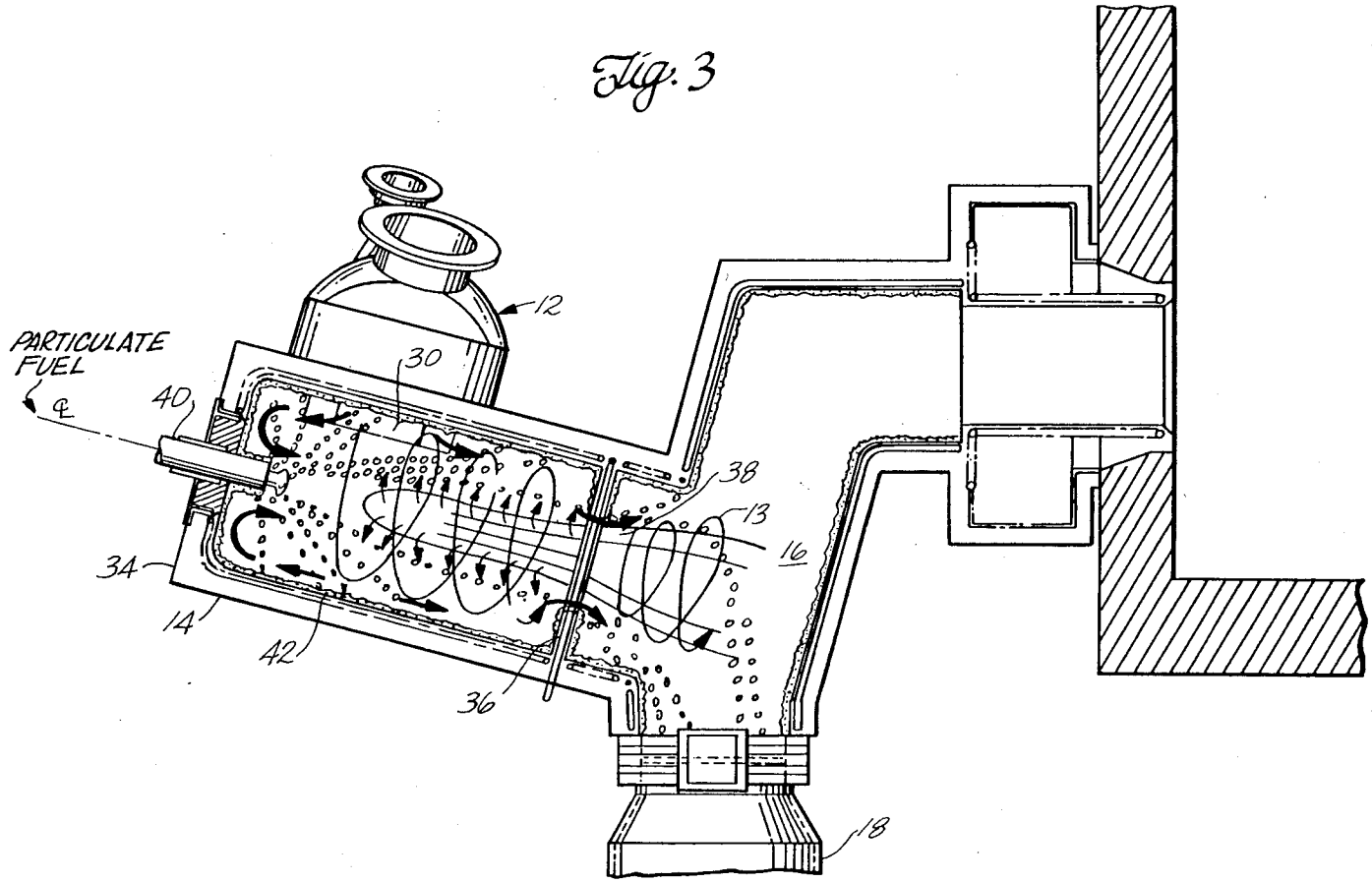
FIG. 3 illustrates the primary combustion chamber in which the instant invention is advantageously used, together with associated apparatus for collecting molton slag and conducting gaseous products to an end-use equipment.

With reference first to FIGS. 1, 2, and 3, the slagging combustion system 10 comprises a precombustion chamber 12, primary combustion chamber 14, and exit chamber 16 with which slag collection unit 18 is associated. As shown in FIG. 1, the bulk of particulate carbonaceous fuel to be consumed, may be supplied from reservoir 20 by line 22 to primary combustion chamber 14. The balance, usually from about 10% to about 25% of the total feed, is fed to precombustion chamber 12 by means of nozzle assembly 24.

While FIG. 1 shows the general perspective arrangement of the system, the presently preferred structure for the several subsystems is detailed with particular reference to FIGS. 2 and 3.

The function of precombustor 12 is to condition the oxidant, normally air, for feed to the primary reaction chamber 14, where the primary feed of particulate carbonaceous material is combusted under substoichiometric, slag-forming conditions.

By the term "particulate carbonaceous material" as used herein, there is meant carbon-containing substances, which can be provided as a fuel source dispersed in a gas or liquid carrier. Representative carbonaceous materials include, among others, coal, char, the organic residue of solid-waste recovery operations, tarry oils which are dispersible in gas or liquid, and the like. All that is required is, that the carbonaceous material to be consumed in the primary combustion chamber be amenable to dispersion within the chamber as discrete particles in a carrier gas or liquid. The most typical form in which the carbonaceous material is provided is that of coal, and the invention will be described in detail in terms of the combustion of coal using water or air as the carrier fluid.

By the term "oxidant" as used herein, there is meant a gaseous source of oxygen, preferably air or oxygen-enriched air.

Preconditioning of the oxidant is achieved in a compact precombustion chamber, ideally of cylindrical geometry, to which the first-stage oxidant is supplied. This first-stage oxidant is fed to combustion air inlet 26 to combine with a minor portion of the particulate carbonaceous material, thereby providing a preheated stream of oxidizer, mixed with combustion products, to primary combustion chamber 14. Of the total fuel to be combusted, per unit of time, about 10% to 25% is fed to precombustion chamber 12. A preferred embodiment of precombustor 12 is described, in more detail, in copending patent application Ser. No. 670,417, filed concurrently herewith and assigned to the assignee of this application.

The heated oxidant and reaction products generated in precombustion chamber 12, move through exit 30 tangentially into primary combustor 14, preferably of cylindrical geometry. The rectangular exit has a length-to-height ratio of about 2.5 to 1.

The center of rectangular exit 30 is located preferably at a point, measured from head end 34 a distance of about $\frac{1}{3}$ to $\frac{1}{2}$ of the length of chamber 14. At such a location, the oxidant and reaction products from the precombustor not only cause a whirling motion of the flow field within the cylindrical primary reactor 14, but, as shown in FIG. 3, the oxidant and reaction product flowing from the precombustor apparatus divide into two substantially equal secondary flows, with one flow whirling spirally along the wall toward head end 34 of primary combustor 14, and the other flow generally moving helically along the wall of the primary combustor toward apertured baffle 36. The head-end flow is turned inward at the head end, and flows axially back toward apertured baffle 36 of the primary combustor, all the while whirling helically around fuel injector 40. Apertured baffle 36 of the primary combustor preferably is a water-cooled baffle plate which is located perpendicular to the the centerline of the primary combustor and has a generally centrally-located aperture 38, the diameter of which is at least about 50% of the diameter of the primary chamber.

The remainder, and major part, of the carbonaceous fuel is introduced into primary combustor 14 at head end 34, through injector assembly 40, which is positioned preferably along the centerline of primary combustor 14. Thus, injector 40 causes the fluid-carried fuel to be introduced in a conical flow pattern, into the generally whirling gas flow field at a net angle of from about 45 degrees to about 90 degrees with respect to the centerline of the primary combustor. The nozzle 40 protrudes into primary combustor 14 from head end 34 to a point upstream of the head-end edge of precombustor exit 30. In accordance with the present invention, this fuel injector 40 is designed, constructed and adapted to maintain a hot external surface so that it absorbs a minimum amount of radiant, thermal energy from the surrounding gases, thereby assuring quick ignition and stable combustion closely adjacent the point of fuel injection.

That portion of the precombustor oxidant and precombustion product which flows toward head end 34 of primary combustor 14 provides an initial ignition and fuel-rich reaction zone, with an overall head-end stoichiometry of from about 0.4 to about 0.5. The gaseous precombustion products carry droplets of molten slag which collect on, and form a semi-molten insulative layer on the inside surfaces of the head end of combustion chamber 14. As illustrated in FIG. 3, the whirling flow field, as well as the conical injection pattern, causes the particulate carbonaceous fuel to move in a generally outward path towards the wall of the primary reactor. The bulk of the combustibles are consumed in flight through the heated oxidant flow field, giving up energy in the form of heat of reaction and further heating the resultant reaction products and local residual oxidant. The solid carbonaceous particles in free flight also are given an axial motion towards the exit baffle 36, such axial motion being imparted by the return axial flow of the head-end oxidant. In operation, essentially all of the carbon contained in the fuel is consumed in flight. Any unconsumed carbon reaches the walls of chamber 14 as a combustible char, which continues to be consumed on wall 42. The whirling flow field centrifugally carries the molten noncombustibles to the wall of the primary combustor.

In particular, the combustion process takes place through a rapid heating of the solids. This causes gasification of volatile reaction products from the combustible part of the solids to extract from about 50% to about 80% of the total combustible material. The remaining solids are combusted essentially as a solid char. The driven-off volatiles combust and react as gases.

The fuel-rich gases generated in the head end of the primary combustor, generally flow towards exit baffle 36 of the primary combustor while the whirling motion is maintained. Typical bulk, average, axial-flow velocities are from about 80 to about 100 fps. Thus, in a five-foot long combustion chamber, for example, typical particles traverse the length of the chamber in transit times of about 40 to 80 milliseconds; substantially all of the carbon content of the injected fuel is converted to oxides of carbon in transit times of less than a few hundred milliseconds and before the gaseous products of combustion exit from the chamber, through apertured baffle 36. The internal flow, mixing, and reaction are further enhanced in primary combustor 14 by a strong secondary recirculation flow along the centerline of primary combustor 14, the flow moving from the center of the baffle aperture 38 towards head end 34 of primary combustor 14. This secondary flow is controlled by the precombustor exit flow velocity and the selection of the diameter of central aperture 38. Preferably, precombustor exit velocity is about 330 fps, and a preferred baffle-opening-diameter to primary-chamber-diameter ratio of approximately 0.5 produces ideal secondary recirculation flows for enhanced control of ignition and overall combustion within primary combustor 14.

The whirling fluid flow is such that its tangential velocity increases in a direction inward from the wall of primary reactor 14, with the increase continuing until approximately the radius of exit baffle 36 is reached. From approximately the radius of exit baffle 36 inward, the tangential velocity decreases to a value of essentially zero at the centerline of the primary combustor. The radially-increasing tangential velocity, in progressing inward from the wall of the primary combustor, varies approximately inversely with the decrease in radius to the point at which the approximate baffle aperture radius is reached. From that point inward to the centerline of the primary reactor, the tangential velocity decays to zero. This radial flow field, in combination with the axial flow field, enables the injected solid particles to be accelerated radially in their early consumption histories, and at the same time enables burned-out particles, down to 10 microns or less in size, to be mechanically trapped within the slag contained along the walls of primary combustor 14.

Injector nozzle 40 is preferably designed in such a manner that its periphery is sufficiently hot to allow molten slag to flow along its external surface towards the point of injection of the dispersed fuel. Slag strips off at a point short of dispersed-fuel injection, and provides additional small-point centers of intense radiation and ignition of the head-end-generated fuel-rich gases, such that time loss from injection to ignition is minimized.

As indicated, the stoichiometry of the primary combustor is selected to be from about 0.7 to about 0.9, preferably from about 0.7 to about 0.8. When the system is regulated to hold the average stoichiometry of chamber 14 within these ranges, the fuel-rich gases are sufficiently hot to produce a molten slag at a temperature sufficiently above the slag-softening temperature such that slag will flow freely along the walls of primary combustor 14. The temperature is not so high, however, that large, vaporized-slag losses will occur. Depending on the chemical composition of the non-combustible mineral constituents of the fuel, the combustion zone temperature will be in the range of from about 2000 to about 3800 or more degrees F., with the heated oxidant entering at a temperature of from about 1200 to about 2000 degrees F.

As shown in FIG. 3, the containment walls of primary combustor 14, including exit baffle 36, are formed, preferably, of water-cooled, tube-and-membrane construction. The tube-and-membrane structure is further equipped with slag-retaining studs (not shown). The containment walls are initially lined with a refractory material, which tends to be eroded away and replaced by solidifying slag, as the system operates over an extended period, under quasi steady-state conditions. In operation, molten slag adheres to the underlying solidified slag layer, with excess slag flowing over the frozen-slag layer. This frozen-and-molten-slag layer provides major thermal and chemical protection to the tube-and-membrane wall structure. Once established, the slag layer maintains a protected wall during long periods of operation.

The internal primary combustor slag-flow pattern is driven by the aerodynamic shear forces of the whirling and axial flow gases, and gravity. By tilting the primary combustor at an angle of approximately 15° with respect to horizontal, a satisfactory slag flow occurs within the primary reactor 14 through a keyhole-like opening 46 in exit baffle 36, and thence to slag collector 18.

Providing a primary combustor length-to-diameter ratio of, normally, 1.5 to 1 or 2 to 1; a baffle diameter-to-primary reactor diameter ratio of 0.5 to 1.0; and with essentially full, free-flight burning of 200-mesh coals, as described herein, virtually no loss of unburned carbon is experienced. Further, excellent wall-slag-layer flow and heat-transfer protection are achieved. The fuel-rich stoichiometry involves a reaction chemistry which yields a minimal nitrous-oxide production in the fuel-rich gases.

The detailed structure and operation of slag-recovery chamber 16 and the slag-removing subsystem 18 are described more specifically in the aforementioned co-pending application Ser. No. 670,417, which application is incorporated herein by reference.

Figure 4:
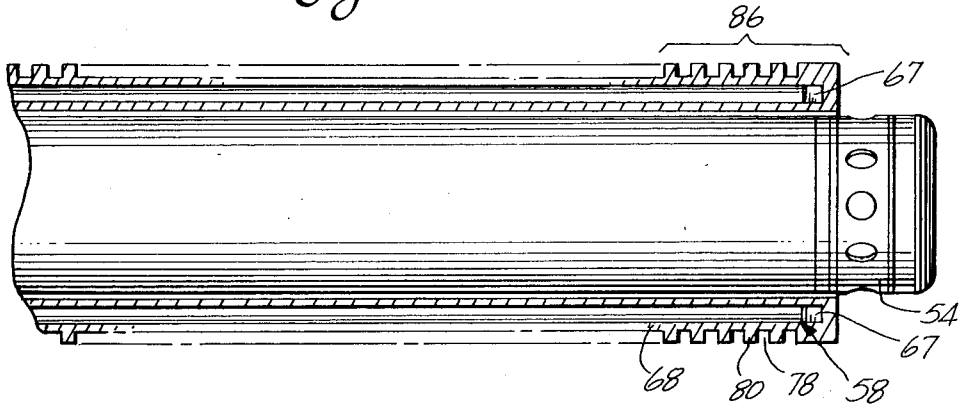
FIG. 4 illustrates in detail a preferred embodiment of an externally-hot injector assembly in accordance with the present invention.
Figure 5:
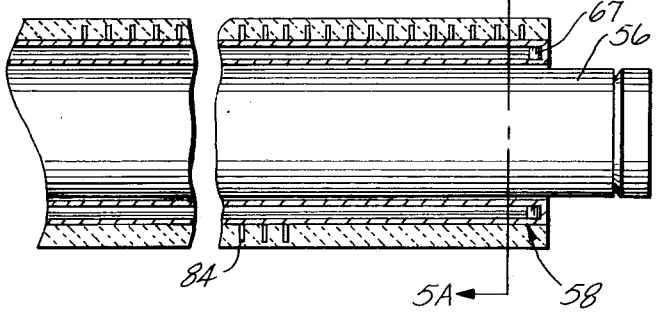
FIGS. 5 and 5A illustrate an alternative embodiment.

With reference now to FIGS. 4 and 5, the nozzle assembly 40 may employ an atomizer-type coal injector 54, which is particularly adapted to the atomization of slurries such as particulate coal in a liquid such as water, or a pintle type-injector 56 as described, for instance, in U.S. Pat. No. 4,217,132 to Burge et al, incorporated herein by reference.

B. Hot-Sleeve Injector Assembly

Figure 5A:
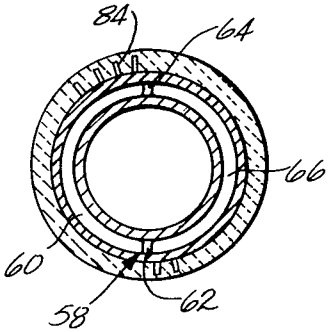

Essential to the dynamics of the operation of the slagging combustor, whether employed for atmospheric-pressure combustion uses or for higher-pressure magnetohydrodynamic applications, is the injection and rapid combustion of particles of carbonaceous material, in a high-velocity whirling flow of oxidizer and preheated precombustion products. Referring now to FIGS. 4, 5 and 5A, atomizer 54 normally injects a coal-water slurry at an angle of about 45 to 90 degrees to the longitudinal axis of primary combustor 14. Pintle 56 injects powdered coal carried in a dense-phase mix with a carrier gas at an angle from 45° to 90° degrees.

The particulate carbonaceous material injected by atomizer nozzle 54 or pintle 56 burn, are consumed and noncombustibles collect as molten slag along the walls of primary combustor 14 and along nozzle assembly 40. The carbonaceous feed must be kept cool to prevent overheating, carburization or agglomeration of the feed and to preserve the nozzle assembly materials of construction in the hot atmosphere which exists within the combustor. To this end, the atomizer or pintle may be, and normally is, water-cooled. This has a tendency to cool the mixture of oxidizer, fuel and combustion products in the vicinity of injector assembly 40. Such cooling is most undesirable. Injection of fuel particles into a local cool environment may produce an unstable flame and extend combustion away from the pont of ejection, thus lessening the time in which combustion can occur. What is desired is, to bring the zone of combustion as close to the point of injection as possible. This requires elevated temperature at the nexis of injection. It is to this end that a beneficial use is made of the molten slag.

To achieve what amounts to an externally-hot injector, the slag, which travels along end wall 34, is kept in a molten state and flows along the surface of nozzle assembly 40 in a direction co current with the feed of the carbonaceous material until it flares off at the end of injector assembly 40. This action of the slag heats, by convection and radiation, the oxidant and particulate carbonaceous material at the zone of injection so as to bring the flame front toward the injection point, adding stability to the flame and initiating ignition as soon as possible.

To assure this result, there is provided in accordance with this invention a slag-retaining sleeve for atomizer 54 or pintle 56, as shown in FIGS. 4 and 5. The sleeve, which enters into end wall 34 of primary combustion chamber 14, includes a liquid-cooled jacket 58, where a liquid such as water flows in one side 60 of jacket 58, through a channel formed by dividing walls 62 and 64, through annular plenum 67, and then out the opposed-side channel 66, on the opposite-side of dividing walls 62 and 64. Suitable conduits (not shown) provide for supply and return of coolant to and from jacket 58 from external the primary combustor 14.

With reference to FIG. 4, extending from the outer wall 68 are a plurality of axial fins 80, which form between them a plurality of grooves 78. Slag forming along the end wall 34 of primary combustor 14, will flow out along nozzle assembly 40 by filling up and then over-flowing into successive grooves, while the fins act as slowing dams. As these grooves are filled, excess slag accumulates on the surface, flares off the end of the jacket, and is carried away in the swirling flow towards the cylindrical walls of primary combustor 14. Because of the flow of water through conduits 60 and 66, the slag at the interface of the heat exchanger is solidified to a substantially solid layer of slag immediately adjacent the metal. On top of that solid layer a second layer of molten and semi-molten slag covers the exterior of jacket 58.

FIGS. 5 and 5A, illustrate an alternative embodiment in which pins 84 extending from the walls of the injector, are used to initially retain refractory material and, as the refractory erodes, form a self-healing layer of slag. The grooves or pins may extend the length of the jacket, or may be limited to an end region 86, depending on design and slag-flow rates.

Using the structure illustrated and described herein, the injector assembly employed to inject the particulate carbonaceous material is maintained sufficiently cool to prevent deleterious softening and agglomeration of the powdered fuel. At the same time, the slag serves as an externally-hot barrier for limiting thermal flux such that the mixture of oxidant and precombustion products adjacently surrounding the injector assembly does not lose significant amounts of heat to the injector. In addition, a small insulating blanket is formed by whatever gas gap exists between the injector and its sleeve, by virtue of the design clearance of from about 0.25 to about 0.5 inch.

In summary, the present invention provides, in a high-power-density slagging combustor, a fuel injector having a relatively very hot external surface so that the mixture of oxidant, fuel and combustion products immediately adjacent thereto are not significantly cooled by are maintained at a more-or-less uniform preselected temperature, usually exceeding 2000° F. Consequently, carbonaceous fuel injected into said mixture is promptly ignited and combusts, with improved stability, closely adjacent the injector and before the fuel particles reach the walls of the combustion chamber.

What is claimed is:

1. In an apparatus for the combustion of pulverized-coal fuel in a combustion zone and separation of the noncombustible-minerals content of the fuel from the gaseous products of combustion as slag, wherein the combustion zone is enclosed within a substantially cylindrical, water-cooled combustion chamber having its walls at temperatures such that a layer of slag is maintained on the inside surfaces of the walls, and wherein oxidant is injected substantially tangentially into said chamber adjacent said inside surfaces in a manner to establish high velocity swirling flow of oxidant, slag droplets, fuel particles and products of combustion within said combustion zone, and wherein a fuel injector for introducing pulverized coal entrained in a flow of carrier fluid extends a substantial distance into said combustion zone substantially along the center line of said chamber and is there immersed in a mixture of oxidant, slag droplets, fuel, and products of combustion, and wherein the fuel input rate relative to the oxidant input rate is regulated in a manner to provide flow velocities and combustion temperatures of about 2000° F. or higher, so that the carbon contained in the fuel is oxidized before the fuel particles reach the walls of the chamber and substantially all of the noncombustible minerals present in the fuel are fused and deposited as liquid slag, and wherein it is desirable to maintain said fuel injector at lower temperatures in order to avoid agglutination of fuel particles and clogging of the injector and wherein substantial cooling of the gaseous mixture immediately adjacent the fuel injector would tend to inhibit combustion of the fuel closely adjacent the fuel injector, the improvement comprising:

(a) a thermal-impedance sleeve peripherally enclosing at least a major portion of said fuel injector and extending within said combustion zone, for impeding the transfer of heat to the injector from the adjacent mixture of oxidant, fuel and products of combustion, said sleeve comprising first and second cylinders positioned coaxially with the second cylinder inside the first cylinder for defining an annular plenum therebetween;

(b) means including at least one water-inflow conduit and at least one water-outflow conduit connected to flow water through said plenum for keeping the temperature of said injector substantially below the ash-fusion temperature of slag produced in said combustion zone; and (c) a coating of relatively high thermal-impedance material formed on and supported by the outermost one of said cylinders and serving to impede the transfer of heat to said sleeve from the gaseous mixture peripherally adjacent thereto, so that the gaseous mixture closely adjacent said sleeve may be maintained substantially at a temperature of about 2000° F. or higher for promoting rapid and stable coal combustion closely adjacent the injector.

2. An apparatus in accordance with claim 1 wherein said coating of high thermal-impedance material consists essentially of slag formed from noncombustible-mineral constituents of the fuel.

3. In an apparatus wherein a fuel injector is immersed in a mixture of oxidant and products of combustion within a combustion zone at temperatures of about 2000° F. or higher, and wherein it is desirable to maintain said fuel injector at a substantially lower temperature while avoiding excessive absorption of energy from the mixture, the improvement comprising means for impeding transfer of heat to the injector from said mixture.

4. In a combustion apparatus wherein a fuel injector extends a substantial distance into a combustion zone and is there immersed in a mixture of oxidant and products of combustion at temperatures of about 2000° F. or higher and wherein it is desirable to avoid excessive absorption of thermal energy from the mixture while keeping said fuel injector at substantially lower temperatures, the improvement comprising means for impeding the transfer of heat to the fuel injector from the adjacent mixture, said means including a material having a thermal conductivity lower than that of the injector, with said material being positioned between said mixture and a major portion of the part of the fuel injector that is within said combustion zone.

5. In an apparatus for high-power-density combustion of particulate carbonaceous fuel wherein a fuel injector extends substantially into a combustion zone and is there immersed in a mixture of oxidant and products of combustion at temperatures of the order of the fuel's ash-fusion temperature or higher, and wherein it is desirable to keep said injector at a temperature substantially lower than that of said mixture while avoiding excessive absorption of heat from the mixture, the improvement comprising a thermal-impedance member surrounding a major portion of the exterior of said fuel injector and means for keeping the interior of said member at temperatures substantially below the ash-fusion temperature of the fuel, with said member having a sufficient thermal impedance so that portions of the mixture immediately adjacent thereto may be kept at temperatures approximating or higher than said ash-fusion temperature.

6. An apparatus in accordance with claim 4 wherein said means for impeding heat transfer comprises a substantially cylindrical metallic sleeve peripherally surrounding a major portion of said injector within said combustion zone, with said sleeve being kept at a temperature substantially below the ash-fusion temperature of slag produced in said combustion zone, and with a layer of material having a relatively high thermal impedance being retained on the exterior surfaces of said sleeve and serving to impede the transfer of heat energy to said sleeve from the higher-temperature gaseous mixture peripherally adjacent thereto, whereby the gaseous mixture immediately adjacent said layer will be kept at temperatures substantially corresponding to or higher than said ash-fusion temperature.

7. An apparatus in accordance with claim 6 in which said sleeve comprises first and second cylinders positioned coaxially with the second cylinder inside the first cylinder for defining an annular plenum therebetween, and means for circulating a cooling fluid into and out of said plenum.

8. A combustion apparatus in accordance with claim 6 wherein said means for impeding heat transfer comprises a thermal-flux barrier, surrounding at least a major portion of the exterior of said fuel injector, said barrier including a material having a coefficient of thermal conductivity substantially lower than that of the fuel injector.

9. A combustion apparatus in accordance with claim 5 wherein said means for impeding heat transfer comprises a thermal-flux barrier, surrounding at least a major portion of the exterior of said fuel injector, said barrier including a material having a coefficient of thermal conductivity substantially lower than that of the fuel injector.

10. An apparatus in accordance with claim 8 wherein said barrier comprises a layer of solidified slag with molten slag on the solidified slag.

11. An apparatus in accordance with claim 9 wherein said barrier comprises a layer of solidified slag with molten slag on the solidified slag.

12. An apparatus for combustion of particulate carbonaceous fuel in accordance with claim 4 wherein said combustion zone is contained within an elongate, substantially cylindrical combustion chamber, said fuel injector extends a substantial distance into said chamber at a location near the center of one end thereof, the gaseous mixture therearound is kept at temperatures of the order of about 2000° F. or higher, and said fuel injector provides coolant flow through at least a portion thereof, whereby the average temperature of the interior of said injector is kept sufficiently low to avoid deleterious agglomeration of particulate carbonaceous fuel flowing through said injector and substantially lower than that of said mixture.

13. An apparatus for combustion of particulate carbonaceous fuel in accordance with claim 5 wherein said combustion zone is contained within an elongate, substantially cylindrical combustion chamber, said fuel injector extends a substantial distance into said chamber at a location near the center of one end thereof, the gaseous mixture therearound is kept at temperatures of about 2000° F. or higher, and said fuel injector provides coolant flow through at least a portion thereof, whereby the average temperature of the interior of said injector is kept sufficiently low to avoid deleterious agglomeration of particulate carbonaceous fuel flowing through said injector.

14. An apparatus for combustion of particulate carbonaceous fuel in accordance with claim 8 wherein said combustion zone is contained within an elongate, substantially cylindrical combustion chamber, said fuel injector extends a substantial distance into said chamber at a location near the center of one end thereof, the gaseous mixture therearound is kept at temperatures of about 2000° F. or higher, and said fuel injector provides coolant flow through at least a portion thereof, whereby the average temperature of the interior of said injector is kept sufficiently low to avoid deleterious agglomeration of particulate carbonaceous fuel flowing through said injector.

15. An apparatus for combustion of particulate carbonaceous fuel in accordance with claim 10 wherein said combustion zone is contained within an elongate, substantially cylindrical combustion chamber, said fuel injector extends a substantial distance into said chamber at a location near the center of one end thereof, the gaseous mixture therearound is kept at tempertures of about 2000° F. or higher, and said fuel injector provides coolant flow through at least a portion thereof, whereby the average temperature of the interior of said injector is kept sufficiently low to avoid deleterious agglomeration of particulate carbonaceous fuel flowing through said injector.

16. In a combustion apparatus wherein a fuel injector extends a substantial distance into a combustion zone and is there immersed in a mixture of oxidant and products of combustion at temperatures of about 2000° F. or higher, and wherein it is desirable to avoid excessive absorption of thermal energy from the mixture while keeping said fuel injector at substantially lower temperatures, the improvement wherein said injector comprises:

(a) an elongate metallic conduit for passing pulverized carbonaceous fuel into said combustion zone;

(b) cooling means including at least one cooling-inflow conduit and one coolant-outflow conduit peripherally adjacent said metallic conduit for keeping the temperature of said conduit substantially lower than the solidification temperature of slag produced in said combustion zone; and (c) means, peripherally encompassing the elements called for in subparagraphs (a) and (b) above and retaining a layer of solidified slag with molten slag adhering to its exterior surfaces, for impeding the transfer of heat to said cooling means from the adjacent portions of said mixture, said means including a material having a thermal conductivity lower than that of the injector, with said material being positioned between said mixture and a major portion of the part of the fuel injector that is within said combustion zone.

17. In an apparatus for high-power-density combustion of particulate carbonaceous fuel wherein a fuel injector extends a substantial distance into an elongate, substantially cylindrical combustion chamber at a location near the center of one end and is there immersed in a mixture of oxidant and products of combustion at temperatures of the order of the fuel's ash-fusion temperature, within the range from about 2000° F. to about 3800° F., the improvement wherein said injector comprises:

(a) an elongate metallic conduit for passing pulverized carbonaceous fuel into said chamber;

(b) means including at least one coolant-inflow conduit and one coolant-outflow conduit disposed adjacent said metallic conduit for keeping the temperature of said conduit substantially lower than the solidification temperature of slag produced in said chamber;

(c) means peripherally encompassing the elements called for in subparagraphs (a) and (b) above, for retaining a layer of solidified slag with molten slag adhering to its exterior surfaces; and (d) with said last-mentioned means constituting a thermal-impedance member for keeping the interior of said member at temperatures substantially below said ash-fusion temperature while portions of the mixture immediately adjacent to said member are kept at temperatures approximating or higher than said ash-fusion temperature.

18. In an apparatus for combustion of carbonaceous fuel wherein a fuel injector extends a substantial distance into an elongate, substantially cylindrical combustion chamber at a location near the center of one end thereof and is there immersed in a mixture of oxidant and products of combustion at temperatures of the order of the fuel's ash-fusion temperature, within the range from about 2000° F. to about 3800° F., the improvement wherein said injector comprises:

(a) an elongate metallic conduit for passing pulverized carbonaceous fuel into said chamber;

(b) means including at least one coolant-inflow conduit and one coolant-outflow conduit peripherally adjacent said metallic conduit for keeping the temperature of said conduit substantially lower than the solidification temperature of slag produced in said combustion zone;

(c) means peripherally encompassing the elements called for in subparagraphs (a) and (b) above, for retaining on the exterior surface thereof, a layer of solidified slag, with molten slag adhering to the solidified slag; and (d) with said last-mentioned means constituting a thermal-flux barrier for impeding the transfer of heat to the fuel injector from the adjacent mixture and thereby avoiding deleterious cooling of said mixture.

19. In an apparatus for high-power-density combustion of particulate carbonaceous fuel wherein a fuel injector extends a substantial distance into an elongate, substantially cylindrical combustion chamber at a location near the center of one end thereof and is there immersed in a mixture of oxidant and products of combustion at temperatures of the order of the fuel's ash-fusion temperature, within the range from about 2000° F. to about 3800° F., the improvement wherein said injector comprises:

(a) an elongate metallic conduit for passing pulverized carbonaceous fuel into said chamber;

(b) means including at least one coolant-inflow conduit and one coolant-outflow conduit peripherally adjacent said metallic conduit for keeping the temperature of said conduit substantially lower than the solidification temperature of slag produced in said combustion zone;

(c) means peripherally encompassing the elements called for in subparagraphs (a) and (b) above, for retaining a layer of solidified slag, with molten slag adhering to the solidified slag; and (d) with said slag having a coefficient of thermal conductivity substantially lower than that of the fuel injector and with said last-mentioned means constituting a thermal-flux barrier for impeding the transfer of heat to the fuel injector from the adjacent mixture and thereby avoiding deleterious cooling of said mixture.

20. A sleeve for retaining molten slag on its surface adapted for surrounding an elongate nozzle for injection of particulate carbonaceous material from at least one orifice into a combustion zone which comprises:

(a) a first elongate conduit for surrounding the body of said nozzle and having a first outer surface;

(b) a second elongate conduit providing a second outer surface and a second inner surface annularly spaced from said first outer surface;

(c) an end wall coupling said first elongate conduit and second elongate conduit providing an annular coolant fluid flow channel between the first and second conduits, said end wall being adapted for positioning adjacent said orifice;

(d) means dividing said annular coolant fluid flow channel into a fluid inlet conduit and a fluid outlet conduit; and (e) a plurality of spaced ribs circumferential to and radially extending from said second outer surface and adapted to engage and retain a layer of molten slag on said second outer surface.

21. A sleeve for retaining molten slag on its surface, adapted for surrounding an elongate nozzle for injection of a particulate carbonaceous material from at least one orifice into an oxidant flow field, which comprises:

(a) a first elongate conduit providing a first inner surface for surrounding the body of said nozzle and a first outer surface;

(b) a second elongate conduit providing a second outer surface and a second inner surface annularly spaced from said first outer surface;

(c) an end wall coupling said first elongate conduit and second elongate conduit providing an annular coolant fluid flow channel between the first and second conduits, said end wall being adapted for positioning adjacent said orifice;

(d) means dividing said annular coolant fluid flow channel into a fluid inlet conduit and a fluid outlet conduit; and (e) a plurality of pins extending radially from the second outer surface and adapted to engage and retain a layer of molten slag on said second outer surface.

22. An apparatus in accordance with claim 16 in which said solidified-slag layer is formed on and supported by a substantially cylindrical, metallic sleeve and further comprising conduit means for conducting a cooling fluid contiguously to the interior surface of said sleeve.

23. An apparatus in accordance with claim 22 in which said sleeve comprises first and second cylinders positioned coaxially with the second cylinder inside the first cylinder.

24. An apparatus in accordance with claim 22 in which said sleeve comprises first and second cylinders positioned coaxially with the second cylinder inside the first cylinder for defining an annular plenum therebetween, and wherein said conduit means is constructed and arranged for circulating a cooling fluid into and out of said plenum.

25. An apparatus in accordance with claim 17 in which said solidified-slag layer is formed on and supported by a substantially cylindrical, metallic sleeve, and further comprising conduit means for conducting a cooling fluid contiguously to the interior surface of said sleeve.

26. An apparatus in accordance with claim 7 in which said sleeve comprises first and second cylinders positioned coaxially with the second cylinder inside the first cylinder.

27. An apparatus in accordance with claim 17 in which said sleeve comprises first and second cylinders positioned coaxially with the second cylinder inside the first cylinder for defining an annular plenum therebetween, and wherein said conduit means is constructed and arranged for circulating a cooling fluid into and out of said plenum.

28. An apparatus in accordance with claim 4 wherein said means for impeding heat transfer comprises a metallic sleeve surrounding said injector with a layer of a material having a relatively low thermal conductivity retained on the exterior surfaces of said sleeve and with molten slag carried on the exterior surfaces of said layer.

29. A combustion apparatus in accordance with claim 5 wherein the outer surface of said sleeve is covered with material, the thermal conductivity of which is substantially lower than that of said sleeve.

30. An apparatus in accordance with claim 5 in which a solidified-slag layer is formed on and supported on said metallic sleeve and further comprising conduit means for conducting coolant contiguously to the interior surface of said sleeve.

31. An apparatus in accordance with claim 5 in which said sleeve comprises first and second cylinders positioned coaxially with the second cylinder inside the first cylinder for defining an annular plenum therebetween, and conduit means for circulating a coolant into and out of said plenum.

32. An apparatus in accordance with claim 5 wherein a layer of a material having a relatively low thermal conductivity is retained on the outer surface of said sleeve with molten slag carried on said layer.

33. An apparatus in accordance with claim 5 wherein said combustion zone is contained within an elongate, substantially cylindrical combustion chamber, said fuel injector extends a substantial distance into said chamber at a location near the center of one end thereof, the gaseous mixture therearound is maintained at temperatures within the range of from about 2000° F. to about 3800° F., and wherein said metallic sleeve comprises:

(a) at least one coolant-inflow conduit and one coolant-outflow conduit for keeping the temperature of said sleeve substantially lower than the ash-fusion temperature of slag produced in said combustion zone, and (b) means for retaining a layer of solidified slag with molten slag adhering to its exterior surfaces.

34. A sleeve for retaining molten slag on its surface surrounding an elongate nozzle adapted for injection of a particulate carbonaceous material from at least one orifice into an oxidant flow field which comprises:

(a) a first elongate conduit providing a first inner surface for surrounding the body of said nozzle and a first outer surface;

(b) a second elongate conduit providing a second outer surface and a second inner surface annularly spaced from said first outer surface;

(c) an end wall coupling said first elongate conduit and second elongate conduit providing an annular coolant fluid flow channel between the first and second conduits, said end wall being adapted for positioning adjacent said orifice;

(d) means dividing said annular coolant fluid flow channel into a fluid inlet conduit and a fluid outlet conduit; and (e) means adapted to engage and retain a layer of molten slag on said second outer surface.

35. A sleeve as claimed in claim 33 in which the means to engage and retain molten slag comprises a plurality of spaced ribs circumferential to, and radially extending from, said second outer surface.

36. A sleeve as claimed in claim 33 in which the means to engage and retain molten slag comprises a plurality of pins extending radially from the second outer surface.

* * * * *